US006524048B1

(12) United States Patent
Tsukada et al.

(10) Patent No.: US 6,524,048 B1
(45) Date of Patent: Feb. 25, 2003

(54) APPARATUS FOR MANUFACTURING CAN LID

(75) Inventors: Shinichi Tsukada, Otaru (JP); Masashi Takamatsu, Otaru (JP); Takeshi Sugimura, Otaru (JP); Akihiro Hamada, Otaru (JP)

(73) Assignee: Showa Seiki Co., Ltd., Hokkaido (JP)

( * ) Notice: Subject to any disclaimer, the term of this patent is extended or adjusted under 35 U.S.C. 154(b) by 0 days.

(21) Appl. No.: 09/571,545

(22) Filed: May 16, 2000

(30) Foreign Application Priority Data

May 18, 1999 (JP) ..... 11-137776
Mar. 17, 2000 (JP) ..... 2000-075449

(51) Int. Cl.[7] ..... B21D 51/44

(52) U.S. Cl. ..... 413/66; 413/67; 413/14; 413/17

(58) Field of Search ..... 413/66, 67, 14, 413/17

(56) References Cited

U.S. PATENT DOCUMENTS 4,106,422 A * 8/1978 Buhrke ..... 413/17
4,136,629 A * 1/1979 Luthi ..... 220/273
RE33,061 E * 9/1989 Brown ..... 413/14
4,932,823 A * 6/1990 Castor et al. ..... 356/621
5,876,171 A * 3/1999 Martin et al. ..... 413/12
6,022,179 A * 2/2000 Artrip ..... 413/14

* cited by examiner

*Primary Examiner*—William Hong
(74) *Attorney, Agent, or Firm*—Birch, Stewart, Kolasch & Birch, LLP

(57) ABSTRACT

A can lid of the fully-open type has a disk-shaped panel, a score notched endlessly in a surface of the panel along an outer circumferential edge of the panel, for forming an opening in the panel, and a tab fixed to the panel by a rivet. The tab is attached in a direction substantially perpendicular to an initial tear-off line of the score. The surface of the panel which is concealed from view by the tab is printed with a circular mark representing a rolling direction in which the material of the panel has been rolled. The score is defined such that the rolling direction extends substantially at a right angle to the initial tear-off line of the score. The panel has an auxiliary score defined in the surface thereof near the rivet and positioned across the rivet from the initial tear-off line substantially parallel to the initial tear-off line and separate therefrom.

13 Claims, 8 Drawing Sheets

FIG.7
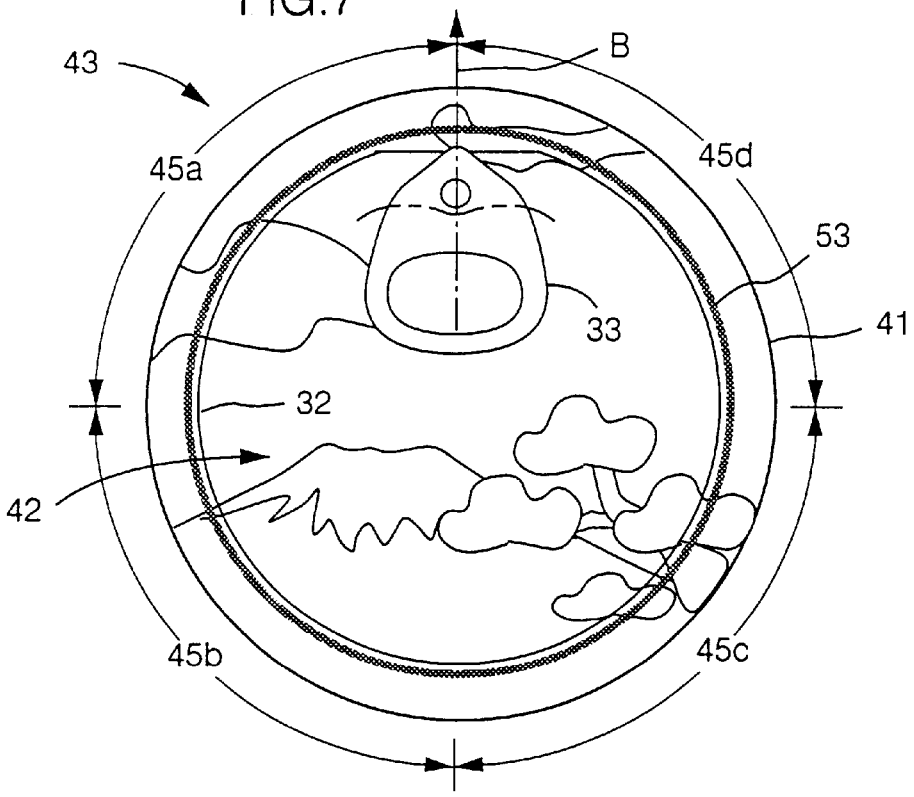
FIG.8(a)
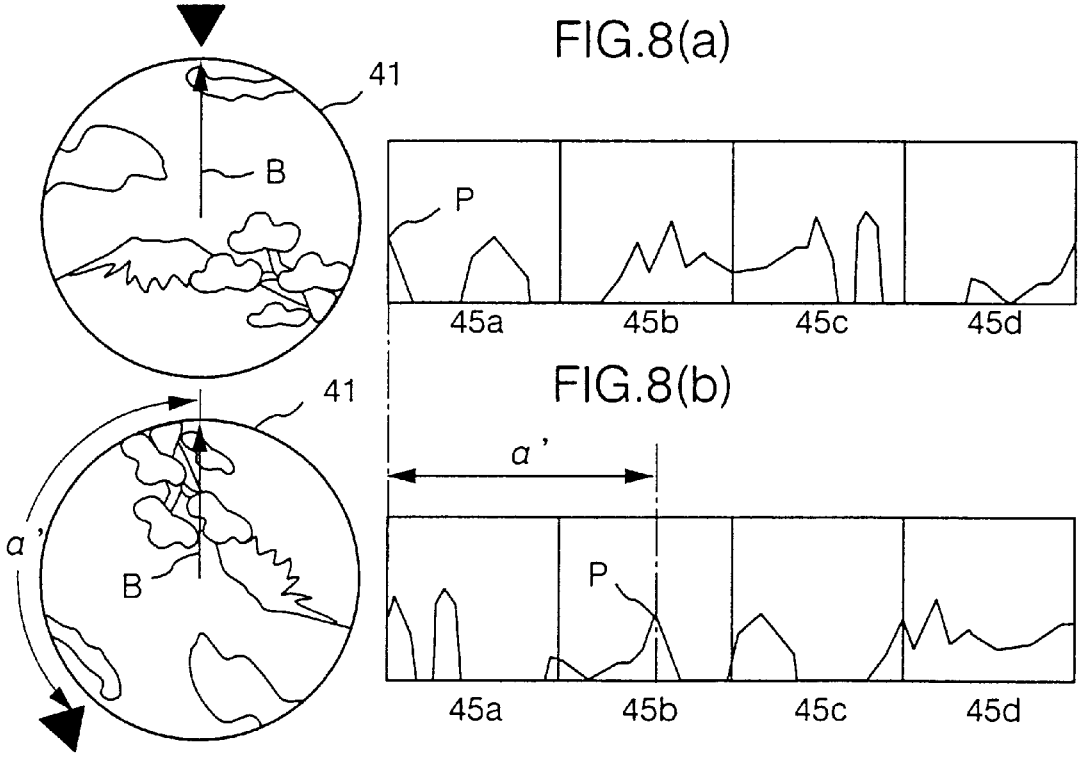
FIG.8(b)

APPARATUS FOR MANUFACTURING CAN LID

BACKGROUND OF THE INVENTION

1. Field of the Invention

The present invention relates an apparatus for manufacturing a can lid.

2. Description of the Related Art

Can lids are generally manufactured by cutting off a metal sheet into a panel in the shape of a can lid with a press or the like, producing a rivet to fix a tab to the panel, thereafter defining a score in a surface of the panel to produce an opening in the panel, and fixing the tab for opening the panel along the score to the panel with the rivet.

If a can lid is printed with an indicia showing how to use the tab on the panel and also the contents of the can, then the indicia is printed on the metal sheet before it is cut off. Thereafter, the metal sheet is cut off into the panel, after which a rivet is produced, a score is defined, and the tab is fixed. However, since the tab and the indicia are not in a particular controlled positional relationship to each other, the tab often conceals part of the indicia from view.

To avoid the above drawback, some conventional can lids are printed with two identical indicia in respective two areas of the can lid, each occupying a substantially half of the can lid, so that the contents of the can will easily be recognized by the consumer even if part of one of the indicia is concealed from view by the tab. Even if part of one of the indicia is concealed from view by the tab, the other indicia is not concealed from view by the tab, allowing the consumer to recognize the contents of the can.

With a can lid being printed with two identical indicia, however, since each of the indicia is printed in the area that takes up a substantially half of the can lid at maximum. Accordingly, the amount of information represented by each of the indicia is smaller than if an indicia is printed on the can lid except an area covered by the tab. Depending on the position where the tab is attached, the tab and the printed information are superposed on each other, tending to impair the aesthetic appearance of the can lid.

To meet various consumer needs in recent years, there has been a demand for pictures, illustrations, etc. to be printed on can lids. However, if tabs are attached in various different positions to can lids with such printed pictures or illustrations, then the aesthetic appearance of the can lids is also reduced.

In view of consumer's daily demands for food and beverage can lids that can be opened more easily, there have been proposed various can lids with improved opening score and tab shapes for easier can openability.

However, even can lids with identical score and tap shapes can be opened by the user under widely different opening forces. Some can lids need to be opened under much greater opening forces than other can lids. When such can lids that can be opened under widely different opening forces are used on canned products, they do not meet consumer's needs for easily openable canned products.

The inventors have found that the positional relationship between the rolling direction of the panel of a can lid and a score and a tab greatly affect an opening force required to open the panel. A sheet from which the panel of a can lid is manufactured has been rolled in a certain rolling direction and cut to a predetermined length. After a disk-shaped panel is blanked out of the sheet, the direction of the blanked panel is not controlled. Therefore, in a subsequent process, the rolling direction and the tab direction in which the tab is fixed to the panel are not in a fixed relationship to each other. After a rivet is produced and a score is defined in the panel, a tab is fixed to the panel. When the tab is fixed to the panel, since the tab direction in which the tab is attached and the rolling direction of the panel are not in a constant relationship to each other, can lids thus manufactured need various opening forces to open the panels.

SUMMARY OF THE INVENTION

It is an object of the present invention to provide an improved apparatus for manufacturing a can lid.

Another object of the present invention is to provide an apparatus for manufacturing a can lid with a tab attached in a position matching a property of a panel of the can lid.

To achieve the above objects, there is provided in accordance with a first aspect of the present invention an improvement in an apparatus for manufacturing a can lid, comprising feed means for feeding a panel to be processed into a can lid, rivet producing means for producing a rivet on the panel fed by the feed means, score notching means for notching a score for opening the panel therealong in the panel which is fed by the feed means and on which the rivet is produced by the rivet producing means, and tab attaching means for securing a tab to the panel which is fed by the feed means and in which the score is notched by the score notching means, with the rivet.

The apparatus also includes detecting means disposed upstream of the rivet producing means, for detecting an indicia representing a tab direction in which the tab is attached, on the panel fed by the feed means, angle calculating means for calculating an angle through which to turn the panel in order to align the tab direction represented by the indicia with a reference direction extending between the center of the panel and a position in which the rivet is produced by the rivet producing means, and turning means for turning the panel through the angle calculated by the angle calculating means.

With the above arrangement, the detecting means detects the indicia representing the tab direction in which the tab is attached, on the panel, and the angle calculating means and the turning means bring the tab direction represented by the indicia into alignment with the reference direction extending between the center of the panel and the position in which the rivet is produced by the rivet producing means. The rivet producing means produces a rivet on the panel with the tab direction aligned with the reference direction, the score notching means notches the score in the panel, and the tab attaching means secures the tab with the rivet. The apparatus according to the present invention can manufacture can lids with tabs secured at a constant position to panels, and hence can manufacture can lids where tabs are attached at a position matching a property of the panels.

If the panel is printed on a surface thereof with a second indicia off a position in which the tab is attached, then the detecting means comprises means for detecting the second indicia, the angle calculating means comprises means for calculating an angle through which to turn the panel in order to align the tab direction represented by the second indicia with the reference direction, and the turning means comprises means for turning the panel through the angle calculated by the angle calculating means, whereby the second indicia is not covered with the tab.

If an instruction remark explanatory of how to use the tab is printed as the second indicia, then since the printed instruction remark is not covered with the tab, the consumer can easily recognize the instruction remark. Since the same indicia is not required to be printed in two locations unlike the conventional practice, a greater amount of information can be printed on the panel than heretofore. Because the second indicia is not covered with the tab, the manufactured can lid has an aesthetic appearance.

Preferably, the detecting means comprises image recognizing means for recognizing the surface of the panel with an image, and the angle calculating means comprises means for dividing the surface of the panel into a normal area which extends up to 180° clockwise from the reference direction and a reverse area which extends less than 180° counterclockwise from the reference direction, calculating an angle clockwise from the reference direction to the indicia if the detected indicia is in the normal area, and calculating an angle counterclockwise from the reference direction to the indicia if the detected indicia is in the reverse area.

The angle calculating means divides an image of the panel recognized by the image recognizing means into the normal area which extends up to 180° clockwise from the reference direction and the reverse area which extends less than 180° counterclockwise from the reference direction. The angle calculating means calculates an angle clockwise from the reference direction to the indicia if the detected indicia is in the normal area, and calculates an angle counterclockwise from the reference direction to the indicia if the detected indicia is in the reverse area. Therefore, the angle calculated by the angle calculating means does not exceeds 180°, and the angle through which the panel is turned by the turning means does not exceeds 180°. Consequently, the indicia can quickly be turned to the reference direction.

In the apparatus according to the first aspect of the present invention, if the indicia representing the tab direction comprises a pattern applied to the panel, the detecting means preferably comprises illuminating means for irradiating the panel with light, light-detecting means for detecting light from the irradiated panel, second turning means for turning one or both of the panel and the light-detecting means, and pattern recognizing means for recognizing the pattern based on a signal produced by the light-detecting means when the light-detecting means detects the reflected light from the panel in a circumferential direction thereof. The angle calculating means comprises means for comparing a normal position pattern for the pattern in a position where the tab direction represented by the pattern is aligned with the reference direction, with the pattern recognized by the pattern recognizing means, and calculating an angle through which to turn the panel in order to align the recognized pattern with the normal position pattern, and the turning means comprises means for turning the panel by the calculated angle.

The pattern applied to the panel is effective in recognizing the tab direction. The second turning means turns one or both of the panel or the light-detecting means, and the light-detecting means detects the reflected light in the circumferential direction from the panel irradiated by the illuminating means. The pattern recognizing means receives the signal from the light-detecting means and recognizes the pattern applied to the panel based on the received signal. The recognized pattern allows the tab direction on the panel to be recognized. The angle calculating means calculates an angular deviation between the recognized pattern and the normal position pattern, and the turning means brings the tab direction on the panel into alignment with the reference direction.

If the pattern is a printed pattern on the panel, then the tab can be secured to the panel at a given position on the printed pattern, the pattern can be designed in view of the position of the tab, so that can lid can be manufactured which satisfies various needs of the consumers and have an aesthetic appearance.

Preferably, the light-detecting means comprises a plurality of sensors disposed at angular intervals in the circumferential direction of the panel, for detecting the reflected light from the panel while one or both of the panel or the light-detecting means are turned through a predetermined angle by the turning means, and the pattern recognizing means comprises means for combining signals from the sensors to recognize the pattern. The sensors disposed at angular intervals in the circumferential direction of the panel are capable of detecting the reflected light from the panel fully in the circumferential direction when one or both of the panel and the light-detecting means are turned through a predetermined angle. Consequently, the reflected light from the panel in the circumferential direction can be detected by the light-detecting means in a short period of time.

In order for the angle calculated by the angle calculating means not to exceed 180°, the angle calculating means preferably comprises means for calculating the angle clockwise if the angle through which to turn the panel to align the recognized pattern with the normal position pattern is up to 180°, and calculating the angle counterclockwise if the angle through which to turn the panel to align the recognized pattern with the normal position pattern is less than 180°.

According to a second aspect of the present invention, there is provided an apparatus for manufacturing a can lid, comprising, in addition to the feed means, the rivet producing means, the score notching means, and the tab attaching means, detecting means for detecting an indicia representing the rolling direction on the panel fed by the feed means, angle calculating means for calculating an angle through which to turn the panel in order that the rolling direction represented by the indicia and a reference direction extending between the center of the panel and a position in which the rivet is produced by the rivet producing means extend at an angle ranging from 0° to 45°, and turning means for turning the panel through the angle calculated by the angle calculating means, the score notching means comprising means for notching the score such that a portion of the score along which the tip end of the tab tears off the panel extends at an angle ranging from 45° to 90° to the rolling direction.

The inventors have found that the force required to open the panel along the score is minimum if the portion of the score along which the tip end of the tab tears off the panel extends perpendicularly to the rolling direction, and that the force required to open the panel along the score is small if the angle from the portion of the score to the rolling direction is 45° clockwise or 45° counterclockwise. In the apparatus according to the second aspect of the invention, the angle calculating means calculates the angle through which to turn the panel in order that the rolling direction and the reference direction extend at an angle ranging from 0° to 45° to each other, and the score notching means notches the score such that the portion of the score along which the tip end of the tab tears off the panel extends at an angle ranging from 45° to 90° to the rolling direction. Therefore, the can lid can be opened under a small opening force whose variations are small.

Preferably, the angle calculating means comprises means for calculating an angle through which to turn the panel in order to align the rolling direction with the reference direction, so that the portion of the score along which the tip end of the tab tears off the panel extends perpendicularly to the rolling direction, minimizing the opening force required to open the panel along the score.

In the apparatus according to the second aspect of the present invention, the angle calculating means preferably comprises means for calculating the angle clockwise if the angle through which to turn the panel in order that the rolling direction and the reference direction extend at an angle ranging from 0° to 45° is up to 180°, and calculating the angle counterclockwise if the angle through which to turn the panel in order that the rolling direction and the reference direction extend at an angle ranging from 0° to 45° is less than 180°. With this arrangement, the angle calculated by the angle calculating means does not exceeds 180°, and the angle through which the panel is turned by the turning means does not exceeds 180°. Consequently, the indicia can quickly be turned to the reference direction.

In the apparatus according to the second aspect of the present invention, if the indicia comprises a striped pattern produced when the metal sheet is rolled, then the detecting means preferably comprises illuminating means for irradiating the panel with light, light-detecting means for detecting light from the irradiated panel, second turning means for turning one or both of the panel and the light-detecting means, and pattern recognizing means for recognizing the striped pattern based on a signal produced by the light-detecting means when the light-detecting means detects the reflected light from the panel in a circumferential direction thereof. The angle calculating means comprises means for comparing a normal position pattern for the striped pattern in a position where the rolling direction represented by the striped pattern is aligned with the reference direction, with the striped pattern recognized by the pattern recognizing means, and calculating an angle through which to turn the panel in order to allow the recognized pattern with the normal position pattern to extent at an angle ranging from 0° to 45° to each other, and the turning means comprises means for turning the panel by the calculated angle.

The panel bears the striped pattern on its surface which is produced when the material of the panel is rolled. When the striped pattern is recognized to detect the rolling direction of the material of the panel, the score can be notched such that the portion of the score along which the tip end of the tab tears off the panel extends at an angle ranging from 45° to 90° to the rolling direction. The can lid thus manufactured can be opened under a small opening force whose variations are small.

In order to minimize the opening force, the angle calculating means preferably comprises means for calculating an angle through which to turn the panel in order to align the recognized pattern with the normal position pattern.

As with the first aspect of the present invention, the light-detecting means preferably comprises a plurality of sensors disposed at angular intervals in the circumferential direction of the panel, for detecting the reflected light from the panel while one or both of the panel or the light-detecting means are turned through a predetermined angle by the turning means, and the pattern recognizing means preferably comprises means for combining signals from the sensors to recognize the striped pattern.

Preferably, if the angle calculating means comprises means for calculating the angle clockwise if the angle through which to turn the panel in order that the recognized pattern and the normal position pattern lie at an angle ranging from 0° to 45° to each other is up to 180°, and calculating the angle counterclockwise if the angle through which to turn the panel in order in order that the recognized pattern and the normal position pattern lie at an angle ranging from 0° to 45° to each other is less than 180°.

The above and other objects, features, and advantages of the present invention will become apparent from the following description when taken in conjunction with the accompanying drawings which illustrate preferred embodiments of the present invention by way of example.

BRIEF DESCRIPTION OF THE DRAWINGS

FIG. 6(*b*) is a plan view of the sensor unit shown in FIG. 6(*a*);

FIG. 7 is a plan view of a can lid manufactured by the apparatus according to the second embodiment of the present invention;

FIGS. 8(*a*) and 8(*b*) are diagrams showing patterns recognized by a pattern recognizing means of the apparatus according to the second embodiment of the present invention;

DESCRIPTION OF THE PREFERRED EMBODIMENTS

Figure 1:
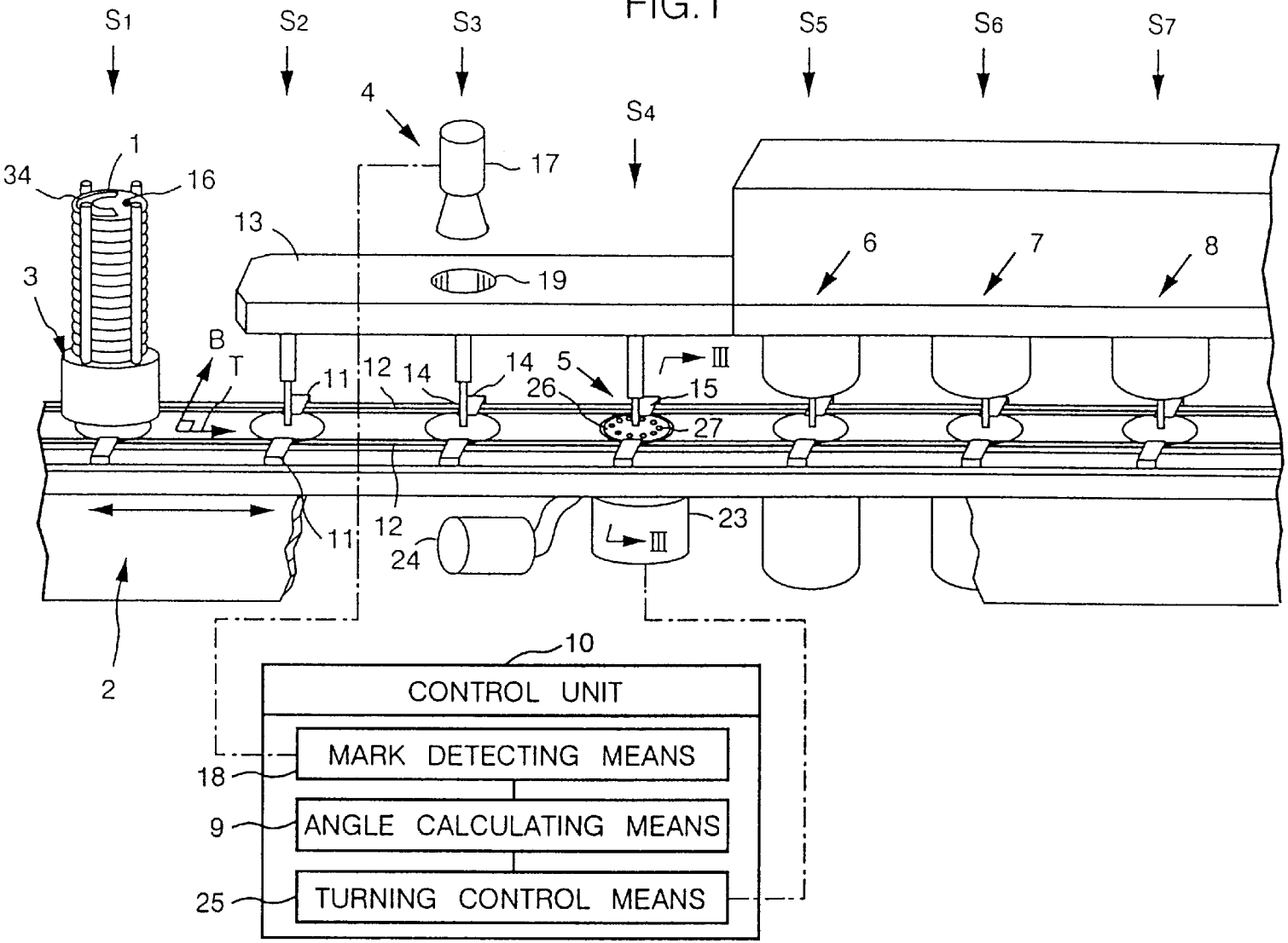
FIG. 1 is a schematic perspective view, partly in block form, an apparatus for manufacturing a can lid according to a first embodiment of the present invention.

As shown in FIG. 1, an apparatus for manufacturing a can lid according to a first embodiment of the present invention includes a feed device 2 for feeding panels 1 for can lids in a feed direction T along a horizontal feed path, a panel supply device 3 for supplying panels 1 to the feed device 2, a detecting device 4, a turning device 5, a rivet producing device 6, a score notching device 7, and a tab attaching device 8. The devices 3, 4, 5, 6, 7, 8 are successively positioned in the order named downstream along the horizontal feed path of the feed device 2. The apparatus also has a control unit 10 spaced from the feed device 2 and electrically connected to the detecting device 4 and the turning device 5. The control unit 10 includes an angle calculating means 9. In the first embodiment, a reference direction B (see also FIGS. 2(*a*) and 2(*b*)) interconnecting the center of a panel 1 and a rivet attaching position 31*a*, described later on, extends at a right angle to the feed direction T.

Figure 3:
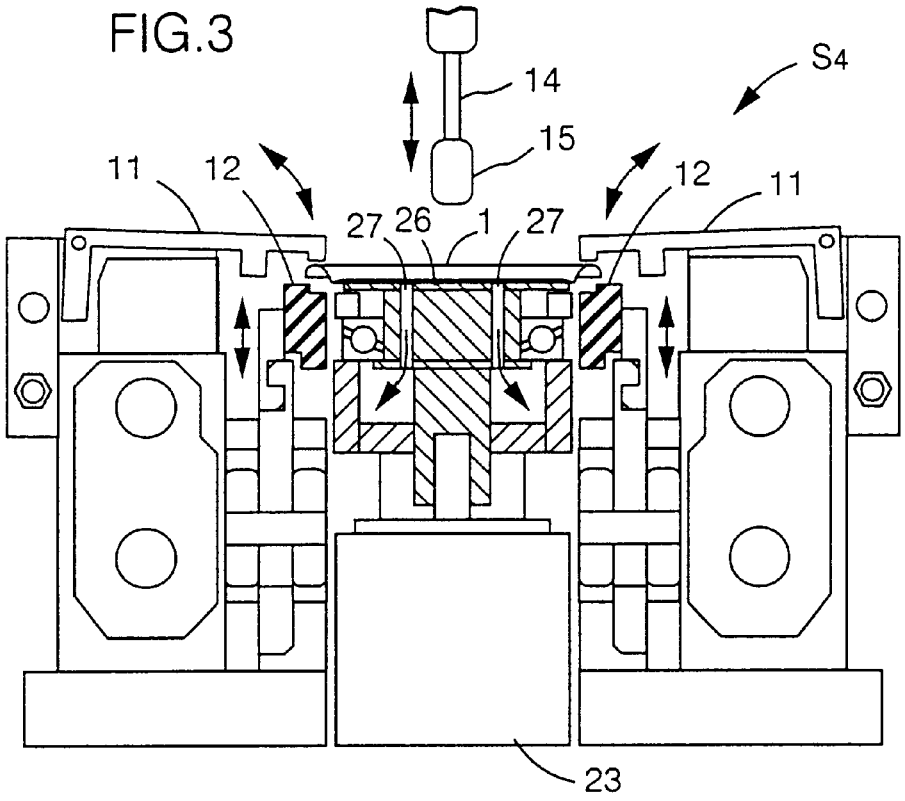
FIG. 3 is a cross-sectional view taken along line III—III of FIG. 1, showing a turning device.

The feed device 2 has an array of first through seventh stations S1–S7 arranged along the feed direction T for placing panels 1 therein in order to process the panels 1. Each of the stations S1–S7 has a pair of arms 11 extending transversely in opposite directions on both sides of the station. Carrier bars 12 are disposed below the arms 11 for gripping a panel 1 and reciprocally moving between adjacent ones of the stations. An upper holder 13 is disposed above the feed device 2 and holds various components above the feed device 2. The upper holder 13 supports vertically movable hold-down pins 14 extending downwardly for holding respective panels 1 near their centers from above. As shown in FIG. 3, the hold-down pin 14 of the fourth station S4 where the turning device 5 is installed has a roll holder 15 angularly movably supported on its distal end by a bearing.

A panel 1 is fed by the feed device 2 as follows: In FIG. 3, the carrier bars 12 are lifted, and the opposite ends of the panel 1 placed in the fourth station S4 are gripped by the distal ends of the arms 11 and the carrier bars 12. Then, while carrying the panel 1, the arms 11 and the carrier bars 12 are moved downstream to the fifth station S5. After the panel 1 is held by the hold-down pin 14, the carrier bars 12 are lowered, releasing the panel 1 from the arms 11 and the carrier bars 12. Then, the arms 11 and the carrier bars 12 are returned to the fourth station S4. In the fourth station S4, when a panel 1 is fed from the third station S3 by the arms 11 and the carrier bars 12, the roll holder 15 is lowered to hold the panel 1, and the arms 11 and the carrier bars 12 are returned to the third station S3. The above operation is also carried out in each of the other stations. In this manner, the feed device 2 feeds panels 1 downstream successively through the stations while holding the panels 1 in one direction against angular movement about their own axis.

The panel supply device 3 is positioned in the first station S1. The panel supply device 3 stores a vertical stack of panels 1, and supplies one panel 1 at a time to the first station S1 each time a panel 1 is fed by the feed device 2. Each of the panels 1 has a mark 16 as a first indicia indicating the position where a tab is attached and an instruction remark 34 as a second indicia. While the panels 1 are being stacked in the panel supply device 3, the directions of the marks 16 and the instruction remark 34 are at random.

As shown in FIG. 1, the detecting device 4 is disposed in the third station S3. The detecting device 4 comprises a CCD camera 17 for capturing an image of a panel 1, and a mark detecting means 18 in the control unit 10 for detecting the position of the mark 16 from the image captured by the CCD camera 17. The CCD camera 17 captures the image of the panel 1 through a window 19 defined in the upper holder 13 such that the center of the panel 1 is located at the center of the image. When the mark detecting means 18 detects a cluster of a predetermined number of pixels in the image from the CCD camera 17, the mark detecting means 18 recognizes the cluster of pixels as the mark 16.

Figure 2A:
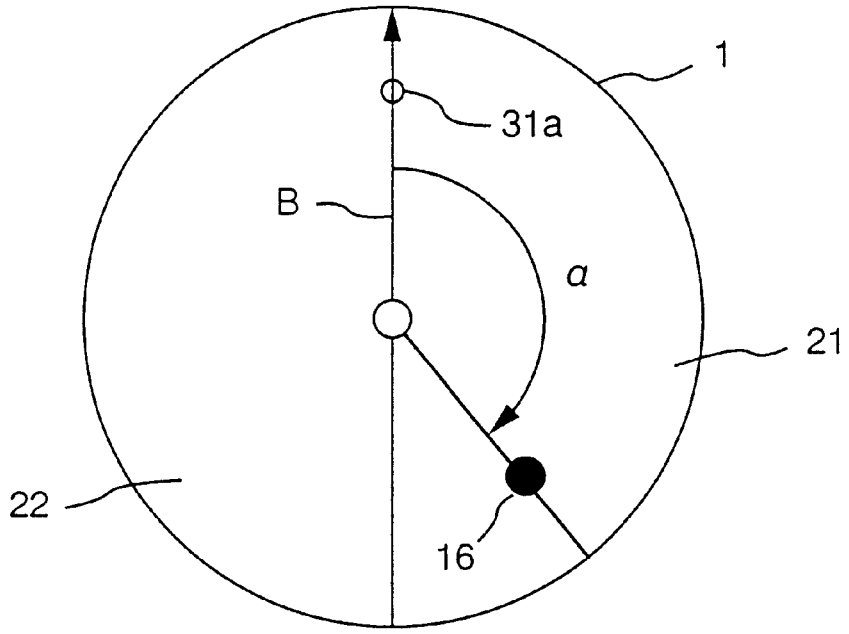
FIGS. 2(*a*) and 2(*b*) are diagrams illustrative of a process of calculating an angle with an angle calculating means.
Figure 2B:
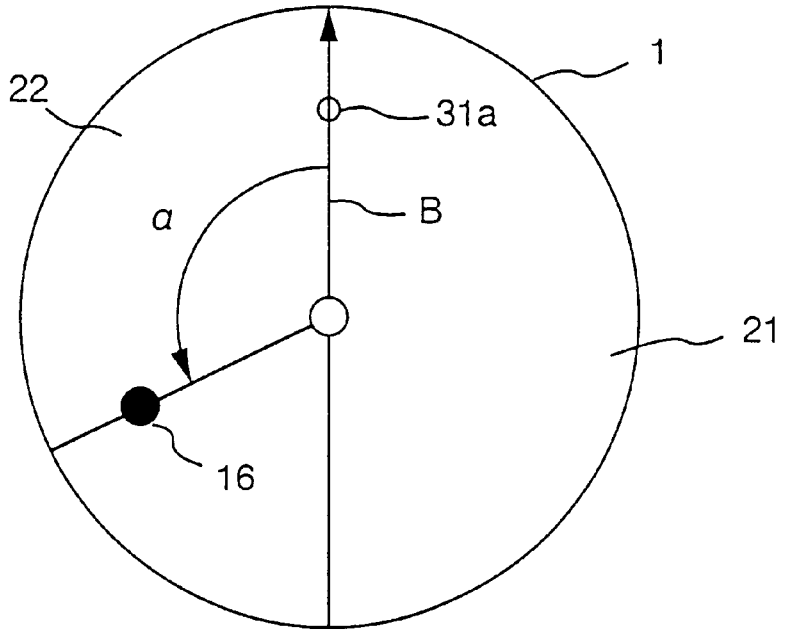

As shown in FIG. 2(*a*), the angle calculating means 9 in the control unit 10 defines, as a normal area 21, an area of a panel 1 which extends up to 180° clockwise from the reference direction B interconnecting the center of the image captured by the CCD camera 17 and the rivet attaching position 31*a* where a rivet 31 is attached to the panel 1. The angle calculating means 9 also defines an area of the panel 1 which extends less than 180° counterclockwise from the reference direction B as a reverse area 22. As shown in FIG. 2(*a*), when the mark 16 detected by the mark detecting means 18 is positioned in the normal area 21, the angle calculating means 9 calculates an angle a of the detected mark 16 clockwise from the reference direction B. As shown in FIG. 2(*b*), when the mark 16 detected by the mark detecting means 18 is positioned in the reverse area 21, the angle calculating means 9 calculates an angle $\alpha$ of the detected mark 16 counterclockwise from the reference direction B.

The turning device 5 is disposed in the fourth station S4. As shown in FIG. 1, the turning device 5 comprises a servomotor 23, a vacuum pump 24, and a turning control means 25 in the control unit 10. The servomotor 23 serves to turn a turntable 26 depending on the information of a direction and an angle that are transmitted from the turning control means 25. In the fourth station S4, a panel 1 is placed on the turntable 26 which is angularly movable by the servomotor 23. The turntable 26 has a plurality of suction holes 27 defined therein and having lower ends connected to the vacuum pump 24, which draws air in the direction indicated by the arrows. When the turntable 26 is turned by the servomotor 23, the panel 1 on the turntable 26 is attracted to the turntable 26 under a vacuum created in the suction holes 27 by the vacuum pump 24, and the panel 1 is held downwardly against the turntable 26 by the roll holder 15.

As shown in FIG. 1, the rivet producing device 6 is disposed in the fifth station S5. In the fifth station S5, a panel 1 is pressed to produce a substantially cylindrical rivet 31 (see FIG. 4) at the rivet attaching position 31*a* on the panel 1 shown in FIGS. 2(*a*) and 2(*b*).

As shown in FIG. 1, the score notching device 7 is disposed in the sixth station S6. In the sixth station S6, the panel 1 is pressed to notch a score 32 in the panel 1 for opening the panel 1 therealong, as shown in FIG. 4.

As shown in FIG. 1, the tab attaching device 8 is disposed in the seventh station S7. In the seventh station S7, a tab 33 is placed on the rivet 31, which is fitted in a through hole defined in the tab 33, and an upper end of the tab 33 is crimped by a press to secure the tab 33 to the rivet 31, as shown in FIG. 4.

Figure 4:
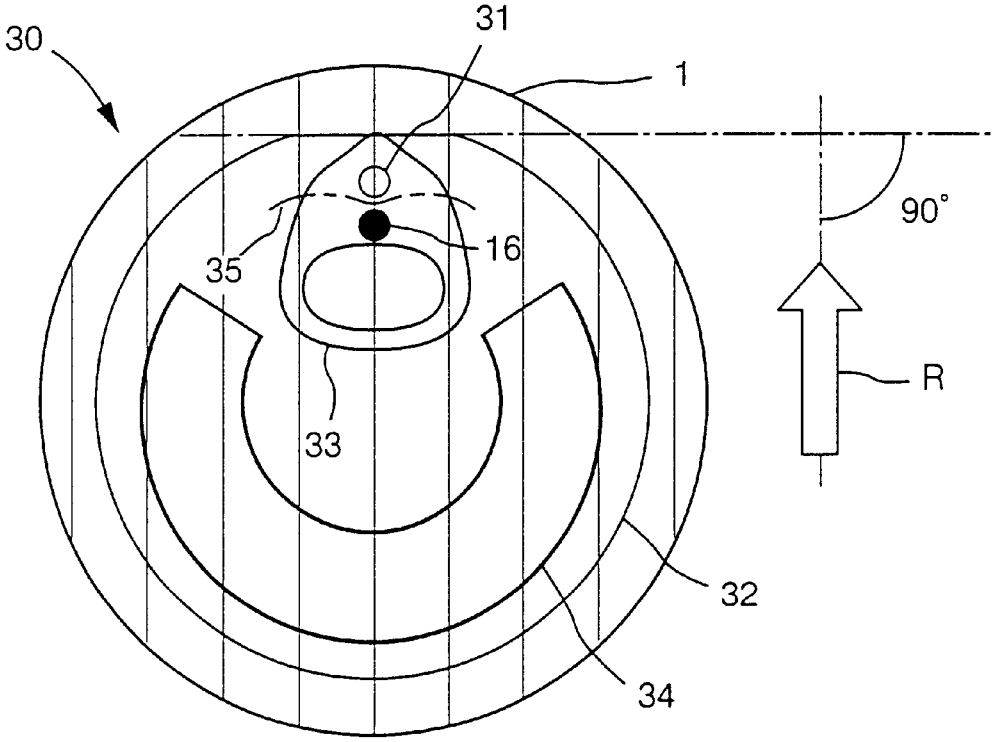
FIG. 4 is a plan view of a can lid manufactured by the apparatus according to the first embodiment of the present invention.

As shown in FIG. 4, a can lid 30 manufactured by the apparatus according to the first embodiment is a fully-open-type can lid which comprises a disk-shaped panel 1, a score 32 notched endlessly in a surface of the panel 1 along an outer circumferential edge of the panel 1, for forming an opening in the panel 1, and a tab 33 fixed to the panel 1 by a rivet 31. The surface of the panel 1 is printed with the instruction remark 34 explanatory of how to use the tab 33 and the mark 16 positioned in confronting relationship to the instruction remark 34. The mark 16 represents the rolling direction R of the material of the panel 1, i.e., the direction in which the material of the panel 1 has been rolled. The panel 1 has an auxiliary score 35 defined in the surface thereof near the rivet 31 and positioned across the rivet 31 from the score 32 substantially parallel to the score 32 and separate therefrom. When the tab 33 is pulled to open the panel 1, the panel 1 is torn off along the auxiliary score 35 before it is torn off along the score 32. Thus, the auxiliary score 35 serves to assist the panel 1 in being torn off along the score 32. The hatching on the panel 1 and the blank arrow represent the rolling direction R. Actually, the mark 16 is concealed from view by the tab 33.

Operation of the apparatus for manufacturing a can lid according to the first embodiment of the present invention will be described below with reference to FIGS. 1 and 4. The panel supply device 3 supplies panels 1 one by one to the first station S1 of the feed device 2. Each of the panels 1 has been blanked as a disk-shaped panel by a press (not shown) out of a metal sheet which has been printed with a mark 16 representing the rolling direction and an instruction remark 34 explanatory of how to use the tab 33 by a printing device (not shown), as the metal sheet is fed in the rolling direction. The panel 1 supplied to the first station S1 is then fed to the second station S2 by the feed device 2. The panel 1 is not processed in the second station S2 as the second station S2 is an idle station.

When the panel 1 is thereafter fed to the third station S3 by the feed device 2, the CCD camera 17 captures an image of the panel 1 through the window 19 defined in the upper holder 13. The image captured by the CCD camera 17 is sent to the mark detecting means 18, which detects the position of the mark 16 in the image. After the image of the panel 1 is captured in the station S3, the panel 1 is fed to the fourth station S4 by the feed device 2.

In the first embodiment, while the panel 1 is being fed from the third station S3 to the fourth station S4, data relative to the position of the mark 16 is transmitted from the mark detecting means 18 to the angle calculating means 9. The angle calculating means 9 detects whether the mark 16 is in the normal area 21 or the reverse area 22, and calculates an angle a of the mark 16 from the reference direction B in the direction of the detected area. For example, if the panel 1 is oriented as shown in FIG. 2(*a*), the angle calculating means 9 calculates the angle $\alpha$ clockwise. Data relative to the direction and angle $\alpha$ is transmitted from the angle calculating means 9 to the turning control means 25.

In the fourth station S4, based on the data relative to the direction and angle $\alpha$ transmitted from the angle calculating means 9, the turning control means 25 energizes the servomotor 23 to turn the turntable 26 thereby to angularly move the panel 1. Specifically, the turning control means 25 sends a turning start signal to the servomotor 23 to turn the servomotor 23 counterclockwise. When the angle through which the servomotor 23 has turned becomes equal to the angle $\alpha$ calculated by the angle calculating means 9, the turning control means 25 sends a turning stop signal to stop turning the servomotor 23. In this manner, the mark 16 on the panel 1 is aligned with the reference direction B.

The panel 1 whose mark 16 is aligned with the reference direction B is then fed to the fifth station S5 by the feed device 2 while the orientation of the panel 1 remains unchanged. In the firth station S5, the rivet producing device 6 produces a rivet 31 on the panel 1 for securing a tab 33 to the panel 1. Then, the panel 1 is fed by the feed device 2 to the sixth station S6 in which the score notching device 7 notches a score 32 and an auxiliary score 35 for opening the panel 1. Thereafter, the panel 1 is fed by the feed device 2 to the seventh station S7 in which the tab attaching device 8 secures a tab 33 for tearing off the panel 1 along the score 32, to the panel 1 with the rivet 31.

In the first embodiment, the rivet 31 and the score 32 are formed and the tab 33 is secured while the mark 16 on the panel 1 is oriented in the reference direction B. Therefore, the instruction remark 34 is not covered with the tab 33. Since the instruction remark 34 may be positioned in one location on the panel 1, the amount of information that can be printed may be larger than if printed in two areas as is conventional. The aesthetic appearance of the can lid 30 is not impaired because the tab 33 does not cover the instruction remark 34 or the instruction remark 34 does not appear on the upper surfaced of the rivet 31. Inasmuch as the mark 16 is positioned so as to be covered with the tab 33, the mark 16 is concealed from view by the tab 33, so that the mark 16 does not reduce the aesthetic appearance of the can lid 30.

Furthermore, because the mark 16 indicates the rolling direction R of the material of the panel 1, the portion of the score 32 along which the tip end of the tab 33 tears off the can lid 30 lies substantially perpendicularly to the rolling direction R. The auxiliary score 35 lies substantially parallel to the portion of the score 32 along which the tip end of the tab 33 tears off the can lid 30. The can lid 30 thus arranged can be opened along the score 32 under a smaller opening force than if the rolling direction R extended parallel to the portion of the score 32 along which the tip end of the tab 33 tears off the can lid 30.

In the first embodiment, the mark 16 is positioned in confronting relationship to the instruction remark 34, and aligned with the reference direction B. However, the mark 16 may be formed as part of the instruction remark 34 and oriented in a direction opposite to the reference direction B. According to such a modification, the angle calculating means 9 calculates the angle from the direction opposite to the reference direction B to the mark 16, and the turning control means 25 turns the panel 1 through the calculated angle to bring the mark 16 into alignment with the direction opposite to the reference direction B. Since the instruction remark 34 is positioned remotely from the position where the tab 33 is attached, the instruction remark 34 is not concealed from view by the tab 33.

The mark 16 is oriented in the rolling direction R in the above embodiment. However, the mark 16 may be located anywhere on the panel 1 insofar as the rolling direction R and the reference direction B are aligned with each other. For example, if the mark 16 is angularly positioned perpendicularly to the rolling direction R, then the turning control means 25 turns the panel 1 to bring the mark 16 into an angular position perpendicular to the reference direction B. In this fashion, the rolling direction R and the reference direction B are aligned with each other.

In the first embodiment, the portion of the score 32 along which the tip end of the tab 33 tears off the can lid 30 extends substantially perpendicularly to the rolling direction R. However, the angle from the portion of the score 32 to the rolling direction R may be 45° clockwise or 45° counterclockwise because the tip end of the tab 33 can tear off the can lid 30 along the score 32 under a relatively small force at those angles.

Figure 5:
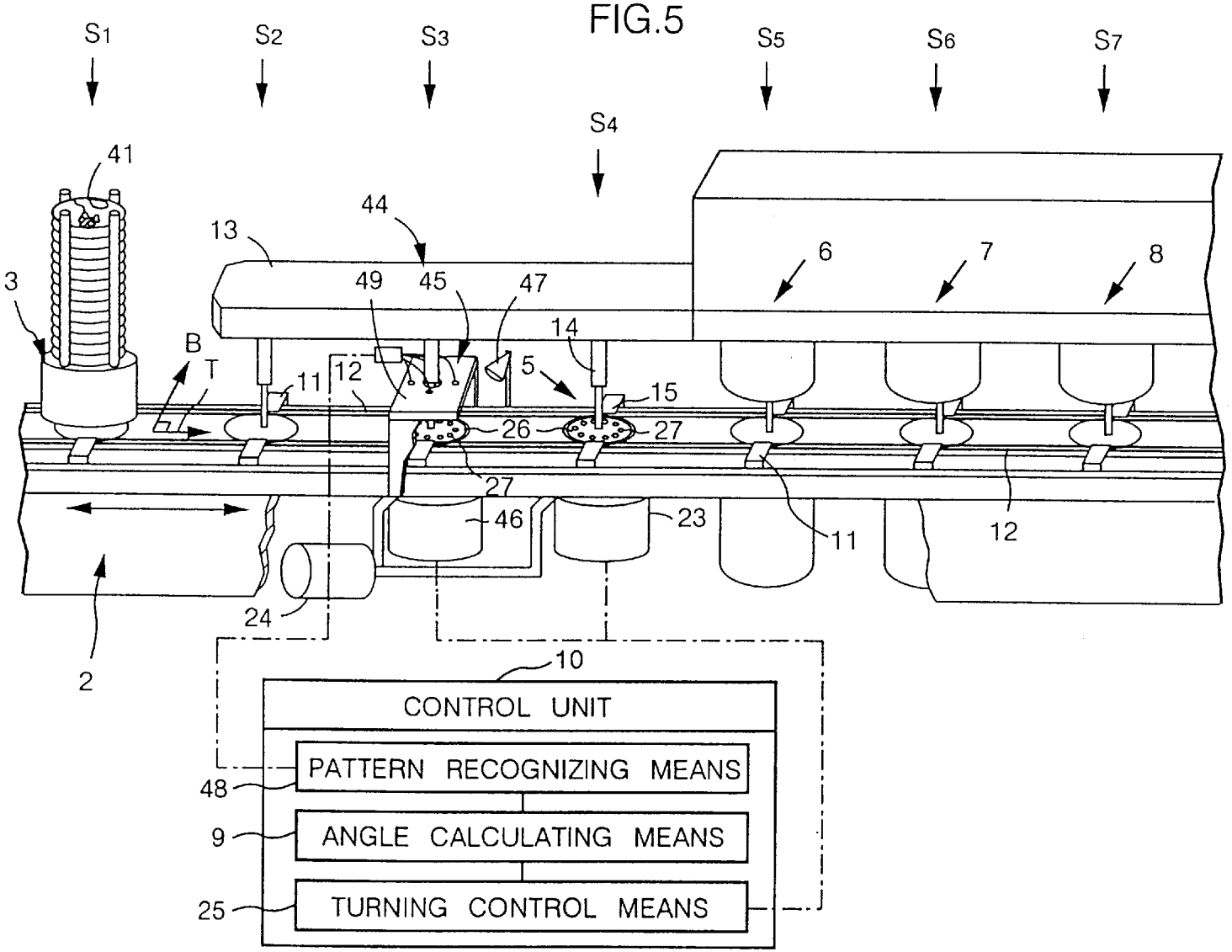
FIG. 5 is a schematic perspective view, partly in block form, an apparatus for manufacturing a can lid according to a second embodiment of the present invention.
Figure 6A:
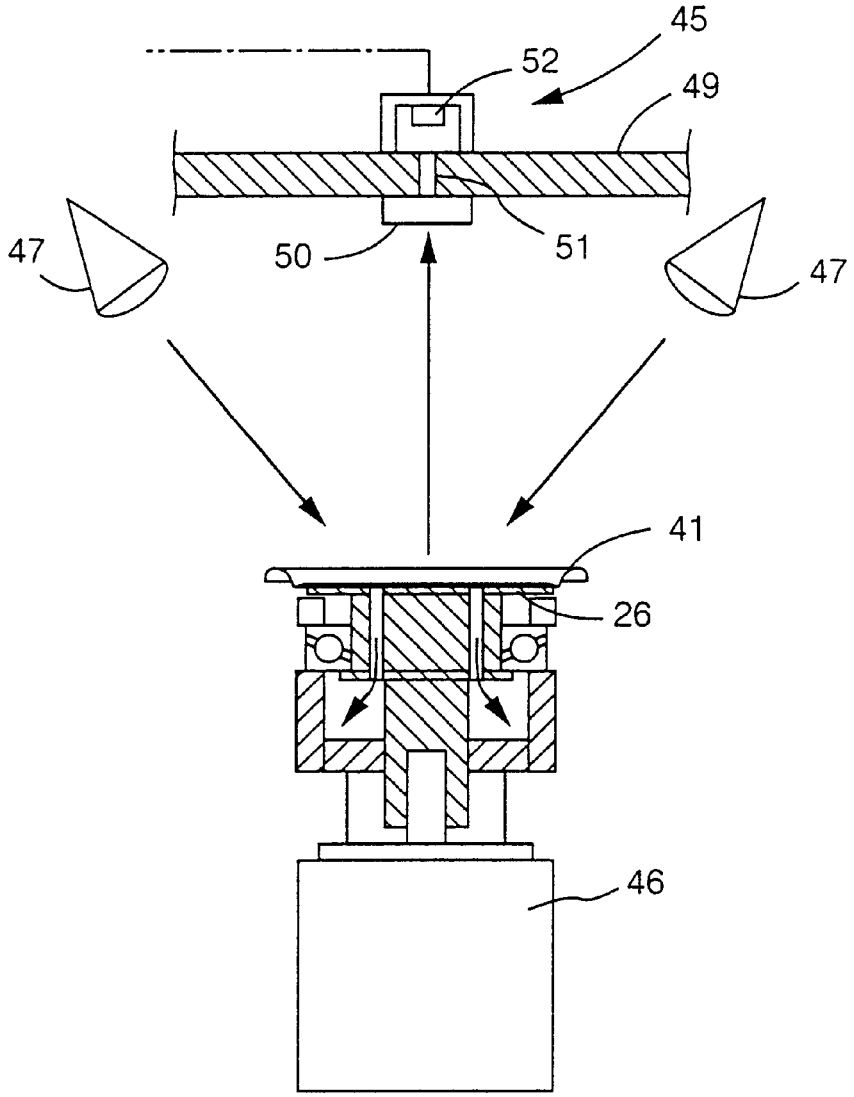
FIG. 6(*a*) is a cross-sectional view of a sensor unit of the apparatus according to the second embodiment of the present invention.
Figure 6B:
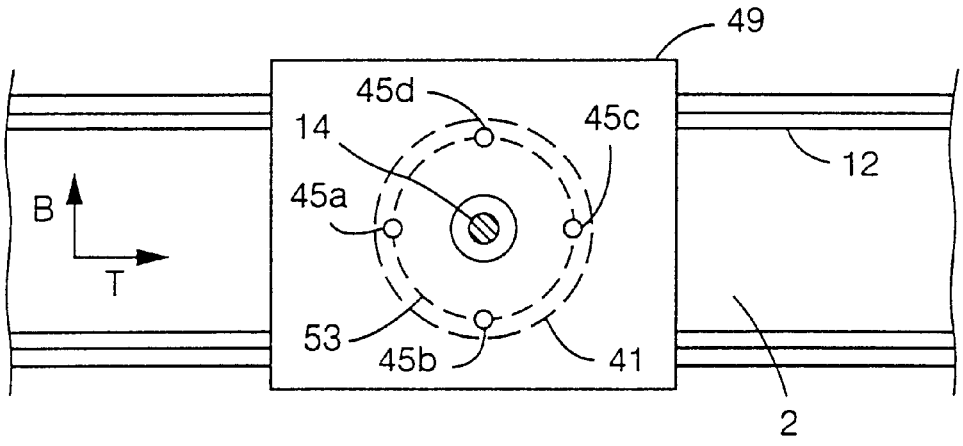

FIGS. 5, 6(*a*), 6(*b*), 7, and 8(*a*), 8(*b*) show an apparatus for manufacturing a can lid according to a second embodiment of the present invention. Those parts of the apparatus according to the second embodiment which are identical to those of the apparatus according to the first embodiment are denoted by identical reference characters, and will not be described in detail below.

As shown in FIG. 7, the apparatus according to the second embodiment serves to manufacture a can lid 43 having a pattern 42 on the surface of a panel 41. As shown in FIG. 5, the apparatus according to the second embodiment has a detecting device 44 in the third station S3. The detecting device 44 comprises a sensor unit (light-detecting means) 45 disposed between the upper holder 13 and the feed device 2, a servomotor 46 (second turning means) connected to the vacuum pump 24 for turning the panel 41, a halogen lamp (illuminating means) 47 for applying light to the panel 41, and a pattern recognizing means 48 disposed in the control unit 10 and electrically connected to the sensor unit 45. The sensor unit 45 is supported on a support member 49 disposed between the upper holder 13 and the feed device 2. As shown in FIG. 6(*a*), the sensor unit 45 comprises a lens 50 directed toward the panel 41, a slit 51 defined in the support member 49 for passing light that has been focused by the lens 50, and a photodiode 52 for detecting light that has passed through the slit 51.

As shown in FIG. 6(*b*), the sensor unit 45 has four sensors 45*a*–45*d* mounted on the support member 49 in a circular pattern slightly radially inward of the outer circumferential edge of the panel 41 and angularly spaced at 90° intervals. The servomotor 46 is arranged to turn the panel 41, which has been fed to the third station S3, clockwise by 90° under the control of the turning control means 25. Each of the sensors 45*a*–45*d* detects light reflected from a detected portion 53 of the panel 41 which is slightly radially inward of the outer circumferential edge thereof, in an angular range of 90°. Therefore, the sensors 45*a*–45*d* can jointly detect the reflected light in a total angular range of 360° for thereby detecting the pattern 42 at the detected portion 53 fully along the entire circumference of the panel 41.

Specifically, as shown in FIG. 6(*b*), an upper left 90° area of the panel 41 is detected by the sensor 45*a*, a lower left 90° area of the panel 41 is detected by the sensor 45*b*, a lower right 90° area of the panel 41 is detected by the sensor 45*c*, and an upper right 90° area of the panel 41 is detected by the sensor 45*d*. FIG. 8(*a*) shows a graph in its right portion which represents a normal position pattern recognized by the pattern recognizing means 48 based on signals from the sensor unit 45 when the pattern 42 on the panel 41 is in a normal position after the panel 41 has been turned 90° by the servomotor 46. In this embodiment, the panel 41 is in the normal position when the pattern 42 has its upper end oriented in the reference direction B.

The stations S1, S2, S4–S7 of the apparatus according to the second embodiment are of the same structure as the corresponding stations of the apparatus according to the first embodiment.

Operation of the apparatus according to the second embodiment will be described below. When a panel 41 is fed to the third station S3 by the feed device 2, the panel 41 is irradiated with light by the halogen lamp 47, and turned 90° by the servomotor 46. The detected portion 53 of the panel 41 reflects the light from the halogen lamp 47 through the lens 50 and the slit 51 to the photodiode 52. The photodiode 52 detects intensity variations of the reflected light which are produced by the pattern 42 on the detected portion 53.

Data representing the detected intensity variations of the reflected light from the detected portion 53 fully around the panel 41 in the third station S3 is transmitted to the pattern recognizing means 48. If the panel 41 is in the angularly position as shown in FIG. 8(*b*) in its left portion after being turned 90° by the servomotor 46, then the pattern recognizing means 48 recognizes a pattern as shown in FIG. 8(*b*) in its right portion. After the pattern 42 on the panel 41 is detected in the third station S3, the panel 41 is fed to the fourth station S4 by the feed device 2.

Then, while the panel 41 is being fed from the third station S3 to the fourth station S4, data of the pattern 42 is transmitted from the pattern recognizing means 48 to the angle calculating means 9. The angle calculating means 9 compares the pattern recognized by the pattern recognizing means 48 with the normal position pattern, and calculates an angle by which the detected pattern deviates from the normal position pattern. In this embodiment, as shown in FIGS. 8(*a*) and 8(*b*), the angle calculating means 9 detects the position where a reference peak P in the normal position pattern is recognized in the recognized pattern, and calculates the deviating angle based on the detected position.

At this time, if the recognized pattern angularly deviates from the normal position pattern clockwise by an angle equal to or smaller than 180°, then the angle calculating means 9 calculates an angle clockwise. If the recognized pattern angularly deviates from the normal position pattern counterclockwise by an angle smaller than 180°, then the angle calculating means 9 calculates an angle counterclockwise. In this embodiment, when the reference peak P is recognized by the sensor 45*a* or 45*b*, the angle calculating means 9 calculates an angle counterclockwise. When the reference peak P is recognized by the sensor 45*c* or 45*d*, the angle calculating means 9 calculates an angle clockwise.

For example, in the pattern 42 recognized as shown in FIG. 8(*b*), since the reference peak P is recognized by the sensor 45*b*, the angle calculating means 9 calculates an angle $\alpha'$ counterclockwise. Information of the angle $\alpha'$ is transmitted from the angle calculating means 9 to the turning control means 25.

In the fourth station S4, the turning control means 25 turns the servomotor 23 based on the information of the angle transmitted from the angle calculating means 9. At this time, the panel 41 on the turntable 26 is attracted to the turntable 26 by the vacuum pump 24, and the panel 41 is held downwardly against the turntable 26 by the hold-down pin 14. The turning control means 25 turns the panel 41 in the angular position shown in the left portion of FIG. 8(*b*) clockwise by the angle $\alpha'$ to bring the pattern 42 on the panel 41 into the normal position shown in the left portion of FIG. 8(*a*).

The panel 41 oriented in the normal position is fed successively downstream through the stations S5–S7 for thereby producing the can lid 43 shown in FIG. 7. The apparatus according to the second embodiment can thus manufacture the can lid 43 whose aesthetic appearance is not impaired by the tab 33 because the pattern 42 and the tab 33 on the can lid 43 shown in FIG. 7 are kept in a certain positional relationship to each other.

An apparatus for manufacturing a can lid according to a third embodiment of the present invention will be described below with reference to FIGS. 5, 9, 10, and 11(*a*), 11(*b*). Those parts of the apparatus according to the third embodiment which are identical to those of the apparatus according to the second embodiment are denoted by identical reference characters, and will not be described in detail below.

Figure 9:
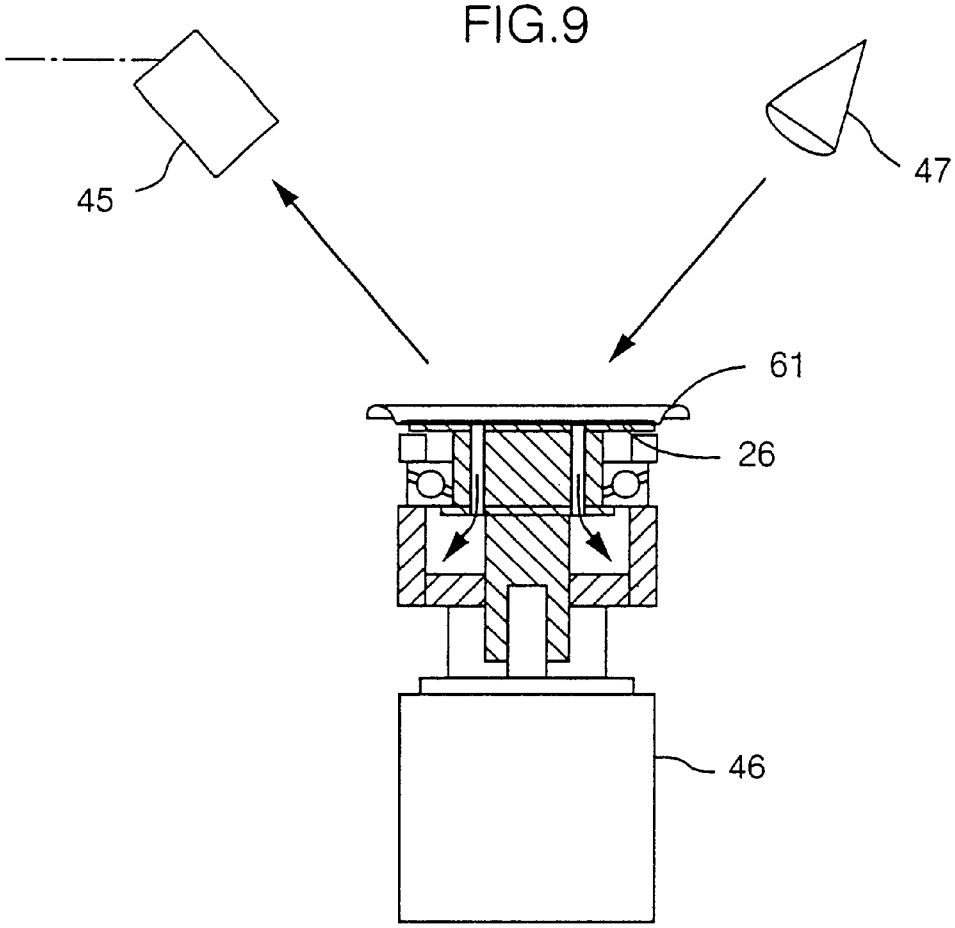
FIG. 9 is a cross-sectional view of a sensor unit of an apparatus for manufacturing a can lid according to a third embodiment of the present invention.
Figure 10:
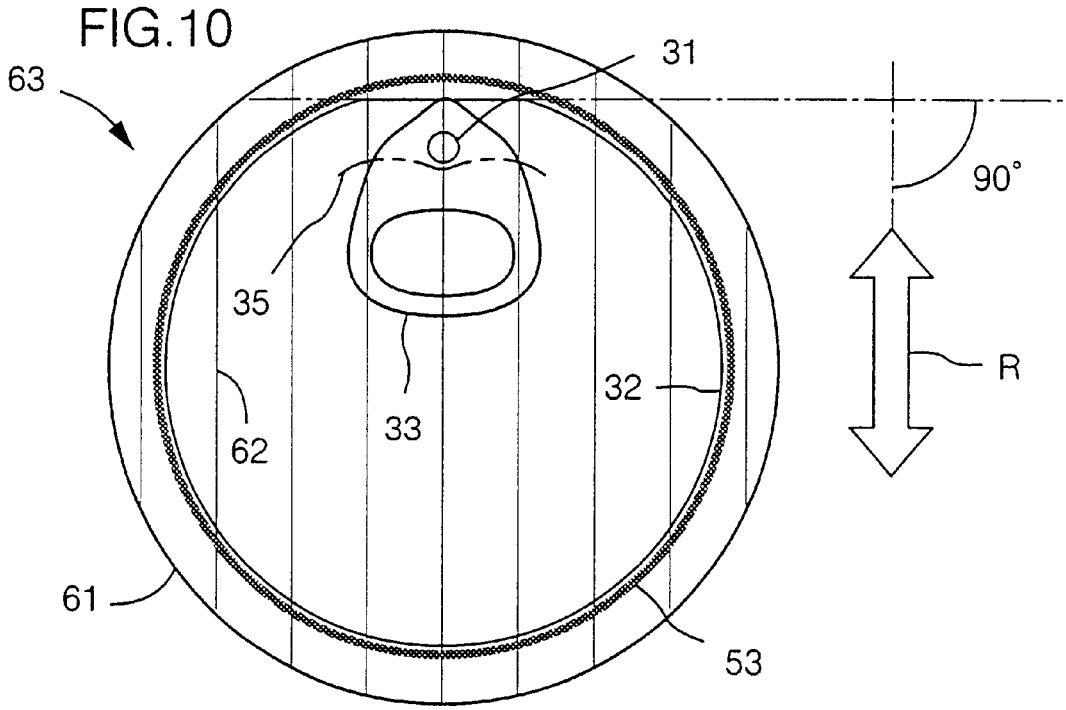
FIG. 10 is a plan view of a can lid manufactured by the apparatus according to the third embodiment of the present invention.

As shown in FIG. 10, the apparatus according to the third embodiment serves to manufacture a can lid 63 having a striped pattern 62 produced on the surface of a panel 61 when the material of the panel 61 is rolled. As shown in FIG. 9, in the apparatus according to the third embodiment, the detecting device 44 in the third station S3 of apparatus has a single sensor 45, and the servomotor 46 turns the panel 61 through 360°. The sensor 45 is halogen lamp 47 is associated with a single halogen lamp 47.

Operation of the apparatus according to the third embodiment will be described below. When the panel 61 is fed to the third station S3 (see FIG. 5) by the feed device 2, the panel 61 is irradiated with light by the halogen lamp 47, and turned 360° by the servomotor 46. The detected portion 53 of the panel 61 reflects the light from the halogen lamp 47 to the sensor 45. The sensor 45 detects intensity variations of the reflected light which are produced by the striped pattern 62 on the detected portion 53.

Figure 11A:
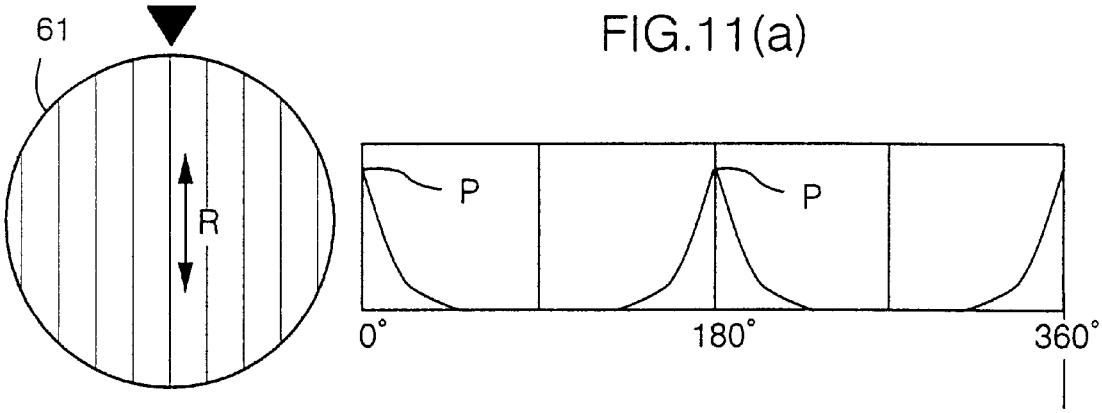
FIGS. 11(*a*) and 11(*b*) are diagrams showing patterns recognized by a pattern recognizing means of the apparatus according to the third embodiment of the present invention.
Figure 11B:
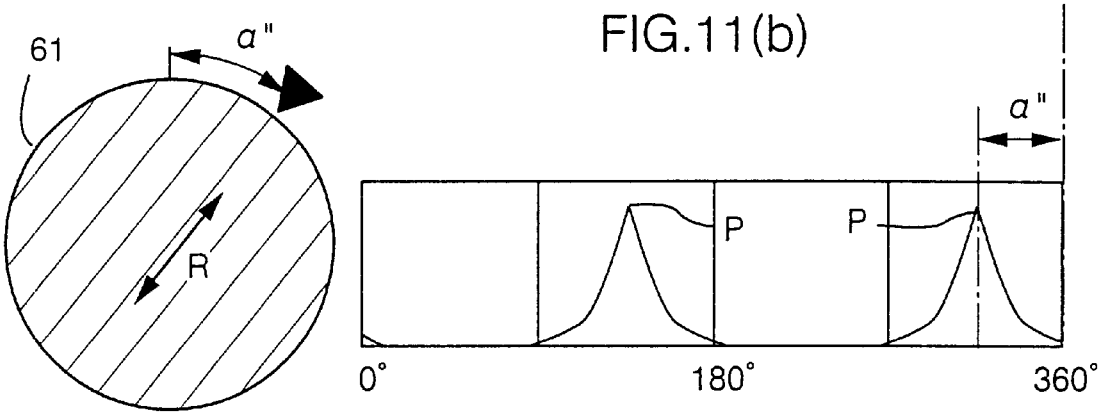

Data representing the detected intensity variations of the reflected light from the detected portion 53 fully around the panel 61 in the third station S3 is transmitted to the pattern recognizing means 48. If the panel 61 is in the angularly position as shown in FIG. 11(*b*) in its left portion, then the pattern recognizing means 48 recognizes the pattern as shown in FIG. 11(*b*) in its right portion. After the striped pattern 62 on the panel 61 is detected in the third station S3, the panel 61 is fed to the fourth station S4 by the feed device 2.

Then, while the panel 61 is being fed from the third station S3 to the fourth station S4, data of the striped pattern 62 is transmitted from the pattern recognizing means 48 to the angle calculating means 9. The angle calculating means 9 compares the pattern recognized by the pattern recognizing means 48 with the normal position pattern, and calculates an angle by which the detected pattern deviates from the normal position pattern. The normal position pattern in this embodiment has two reference peaks P at an interval of 180°, as shown in FIG. 11(*a*).

In this embodiment, the striped pattern 62 recognized in the angular position shown in FIG. 11(*b*) has two reference peaks P. The angle calculating means 9 calculates a smaller one of angles by which the panel 61 is to be turned to bring the rolling direction R of the material of the panel 61 into alignment with the tab direction in which the tab 33 is to be attached to the panel 61. In the illustrated embodiment, the calculated angle is α" counterclockwise. Since the rolling direction R of the material of the panel 61 may be aligned with the tab direction in which the tab 33 is to be attached to the panel 61, if the panel 61 is angularly displaced 180° from the reference position, then it is not necessary to turn the panel 61. Therefore, the maximum angle through which the panel 61 is turned is 90°.

In the fourth station S4 (see FIG. 5), the servomotor 23 is energized by the turning control means 25 based on the information of the angle transmitted from the angle calculating means 9. The turning control means 25 turns the panel 61 in the angular position shown in the left portion of FIG. 11(*b*) counterclockwise by the angle of α", thus bringing the striped pattern 62 on the panel 61 to the normal position shown in FIG. 11(*a*).

The panel 61 oriented in the normal position is fed successively downstream through the stations S5–S7 for thereby producing the can lid 63 shown in FIG. 10. On the can lid 63, the portion of the score 32 which is torn off by the tip end of the tab 33 extends perpendicularly to the rolling direction R.

If the portion of the score 32 which is torn off by the tip end of the tab 33 extends at an angle ranging from 45° to 90° to the rolling direction R, then the can end can be opened under a small opening force. Therefore, if the angle through which to turn the panel 61 into the normal position is equal to or less than 45° clockwise or counterclockwise, then the angle information transmitted to the turning control means 25 may be 0°, so that the servomotor 23 may not be turned by the turning control means 25. Alternatively, the angle calculating means 9 may detect an angle through which to turn the panel 61 into the normal position and transmit the detected angle to the turning control means 25, and if the transmitted angle is equal to or less than 45° in the turning control means 25, then the turning control means 25 may not turn the panel 61.

The apparatus according to the third embodiment can produce the can lid 63 that can be opened under a small opening force, because the striped pattern 62 produced on the surface of the panel 61 when the material of the panel 61 is rolled allows the rolling direction R and the tab direction in which the tab 33 is attached to be held in a certain relationship to each other.

The apparatus according to the above embodiments of the present invention have the detecting device 4 and the turning device 5 disposed in the idle station to which the panels 1, 41 are fed, in addition to the feed device of the conventional apparatus for manufacturing a can lid. Therefore, the apparatus according to the above embodiments of the present invention can easily be converted from the conventional apparatus without major modifications.

In the second and third embodiments, the panels 41, 61 are turned and the light reflected therefrom is detected in the third station S3. However, the support member 49 may be made angularly movable to allow the sensor unit 45 to be turned. With the sensor 45 allowed to be turned, the pattern 42 and the striped pattern 62 can also be detected at the detected portion 53 near the outer circumferential edge of the panels 41, 61 fully around the panels 41, 61.

Rather than turning either the panels 41, 61 or the sensor unit 45, both the panels 41, 61 and the sensor unit 45 may be turned. In the case where the panels 41, 61 and the sensor unit 45 are turned, according to the second embodiment, since the sensor unit 45 is composed of the four sensors 45*a*–45*d*, the sensor 45 may be turned clockwise by 45° and the panel 41 may be turned counterclockwise by 45°, for example, so that the pattern 42 can be detected fully around the panel 41. In the third embodiment, the sensor 45 may be turned clockwise by 180° and the panel 61 may be turned counterclockwise by 180°, for example, so that the striped pattern 62 can be detected fully around the panel 61.

In the second embodiment, the detecting device 44 detects intensity variations of the light reflected from the pattern 42 on the panel 41 with the photodiode 52 to detect the pattern. However, the pattern 42 may be detected by detecting the color thereof.

Although certain preferred embodiments of the present invention have been shown and described in detail, it should be understood that various changes and modifications may be made therein without departing from the scope of the appended claims.

What is claimed is:

1. An apparatus for manufacturing a can lid, comprising:

feed means for feeding a panel to be processed into a can lid;

rivet producing means for producing a rivet on said panel fed by said feed means;

score notching means for notching a score for opening the panel therealong in the panel which is fed by said feed means and on which the rivet is produced by said rivet producing means;

tab attaching means for securing a tab to the panel which is fed by said feed means and in which the score is notched by said score notching means, with said rivet;

detecting means disposed upstream of said rivet producing means, for detecting an indicia representing a tab direction in which the tab is attached, on the panel fed by said feed means;

angle calculating means for calculating an angle through which to turn the panel in order to align said tab direction represented by said indicia with a reference direction extending between the center of said panel and a position in which the rivet is produced by said rivet producing means; and turning means for turning said panel through said angle calculated by said angle calculating means.

2. An apparatus according to claim 1, wherein said panel is printed on a surface thereof with a second indicia off a position in which the tab is attached, said detecting means comprising means for detecting said second indicia, said angle calculating means comprising means for calculating an angle through which to turn the panel in order to align said tab direction represented by said second indicia with said reference direction, and said turning means comprising means for turning said panel through said angle calculated by said angle calculating means, whereby said second indicia is not covered with said tab.

3. An apparatus according to claim 1, wherein said detecting means comprises image recognizing means for recognizing the surface of said panel with an image, said angle calculating means comprising means for dividing the surface of said panel into a normal area which extends up to 180° clockwise from said reference direction and a reverse area which extends less than 180° counterclockwise from said reference direction, calculating an angle clockwise from said reference direction to said indicia if the detected indicia is in said normal area, and calculating an angle counterclockwise from said reference direction to said indicia if the detected indicia is in said reverse area.

4. An apparatus according to claim 1, wherein said indicia representing the tab direction comprises a pattern applied to said panel, said detecting means comprising illuminating means for irradiating said panel with light, light-detecting means for detecting light from the irradiated panel, second turning means for turning one or both of said panel and said light-detecting means, and pattern recognizing means for recognizing said pattern based on a signal produced by said light-detecting means when said light-detecting means detects the reflected light from said panel in a circumferential direction thereof, said angle calculating means comprising means for comparing a normal position pattern for said pattern in a position where said tab direction represented by said pattern is aligned with said reference direction, with the pattern recognized by said pattern recognizing means, and calculating an angle through which to turn said panel in order to align the recognized pattern with said normal position pattern, and said turning means comprising means for turning said panel by the calculated angle.

5. An apparatus according to claim 4, wherein said light-detecting means comprises a plurality of sensors disposed at angular intervals in the circumferential direction of said panel, for detecting the reflected light from said panel while one or both of said panel or said light-detecting means are turned through a predetermined angle by said turning means, said pattern recognizing means comprising means for combining signals from said sensors to recognize said pattern.

6. An apparatus according to claim 4, wherein said angle calculating means comprises means for calculating the angle clockwise if the angle through which to turn the panel to align the recognized pattern with said normal position pattern is up to 180°, and calculating the angle counterclockwise if the angle through which to turn the panel to align the recognized pattern with said normal position pattern is less than 180°.

7. An apparatus for manufacturing a can lid, comprising:

feed means for feeding a panel to be processed into a can lid, said panel being formed from a metal sheet which has been rolled in a given rolling direction;

rivet producing means for producing a rivet on said panel fed by said feed means;

score notching means for notching a score for opening the panel therealong in the panel which is fed by said feed means and on which the rivet is produced by said rivet producing means;

tab attaching means for securing a tab to the panel which is fed by said feed means and in which the score is notched by said score notching means, with said rivet;

detecting means for detecting an indicia representing said rolling direction on said panel fed by said feed means;

angle calculating means for calculating an angle through which to turn said panel in order that said rolling direction represented by said indicia and a reference direction extending between the center of said panel and a position in which the rivet is produced by said rivet producing means extend at an angle ranging from 0° to 45° to each other; and turning means for turning said panel through said angle calculated by said angle calculating means;

said score notching means comprising means for notching said score such that a portion of said score along which the tip end of said tab tears off the panel extends at an angle ranging from 45° to 90° to said rolling direction.

8. An apparatus according to claim 7, wherein said angle calculating means comprises means for calculating an angle through which to turn said panel in order to align said rolling direction with said reference direction.

9. An apparatus according to claim 7, wherein said angle calculating means comprises means for calculating the angle clockwise if the angle through which to turn said panel in order that said rolling direction and said reference direction extend at an angle ranging from 0° to 45°, is up to 180°, and calculating the angle counterclockwise if the angle through which to turn said panel in order that said rolling direction and said reference direction extend at an angle ranging from 0° to 45°, is less than 180°.

10. An apparatus according to claim 7, wherein said indicia comprises a striped pattern produced when the metal sheet is rolled, said detecting means comprising illuminating means for irradiating said panel with light, light-detecting means for detecting light from the irradiated panel, second turning means for turning one or both of said panel and said light-detecting means, and pattern recognizing means for recognizing said striped pattern based on a signal produced by said light-detecting means when said light-detecting means detects the reflected light from said panel in a circumferential direction thereof, said angle calculating means comprising means for comparing a normal position pattern for said striped pattern in a position where said rolling direction represented by said striped pattern is aligned with said reference direction, with the striped pattern recognized by said pattern recognizing means, and calculating an angle through which to turn said panel in order to allow the recognized pattern with said normal position pattern to extent at an angle ranging from 0° to 45° to each other, and said turning means comprising means for turning said panel by the calculated angle.

11. An apparatus according to claim 10, wherein said angle calculating means comprises means for calculating an angle through which to turn said panel in order to align the recognized pattern with said normal position pattern.

12. An apparatus according to claim 10, wherein said light-detecting means comprises a plurality of sensors disposed at angular intervals in the circumferential direction of said panel, for detecting the reflected light from said panel while one or both of said panel or said light-detecting means are turned through a predetermined angle by said turning means, said pattern recognizing means comprising means for combining signals from said sensors to recognize said striped pattern.

13. An apparatus according to claim 10, wherein said angle calculating means comprises means for calculating the angle clockwise if the angle through which to turn said panel in order that the recognized pattern and said normal position pattern lie at an angle ranging from 0° to 45° to each other is up to 180°, and calculating the angle counterclockwise if the angle through which to turn said panel in order in order that the recognized pattern and said normal position pattern lie at an angle ranging from 0° to 45° to each other is less than 180°.

* * * * *